US005597295A

United States Patent [19]

Pipaloff

[11] Patent Number: 5,597,295

[45] **Date of Patent: *Jan. 28, 1997**

[54] MULTI-CHAMBER ROTARY FLUID MACHINE WITH AT LEAST TWO RING MEMBERS CARRYING VANES

[76] Inventor: Alexander G. Pipaloff, 1408 Stanford St., Irvine, Calif. 92715

[ * ] Notice: The term of this patent shall not extend beyond the expiration date of Pat. No. 5,375,985.

[21] Appl. No.: 320,217

[22] Filed: Oct. 11, 1994

Related U.S. Application Data

[60] Continuation-in-part of Ser. No. 224,666, Apr. 7, 1994, abandoned, which is a division of Ser. No. 974,191, Nov. 10, 1992, Pat. No. 5,375,985.

[51] Int. Cl.[6] ..... F01C 1/344; F01C 1/356; F01C 11/00; F01C 19/00

[52] U.S. Cl. ..... 418/6; 418/174; 418/175; 418/177; 418/209; 418/258

[58] Field of Search ..... 418/6, 173–175, 418/177, 209, 258

[56] References Cited

U.S. PATENT DOCUMENTS

| | | | |
|---|---|---|---|
| 677,752 | 7/1901 | Bellas | 418/6 |
| 1,872,361 | 8/1932 | Tackman | 418/6 |
| 2,099,193 | 11/1937 | Brightwell | 418/177 |
| 2,891,482 | 6/1959 | Menon | 418/173 |
| 5,375,985 | 12/1994 | Pipaloff | 418/6 |

FOREIGN PATENT DOCUMENTS

| | | | |
|---|---|---|---|
| 59-41602 | 3/1984 | Japan | 418/209 |
| 60-206990 | 10/1985 | Japan | 418/177 |
| 1-155091 | 6/1989 | Japan | 418/177 |
| 668692 | 3/1952 | United Kingdom | 418/6 |

*Primary Examiner*—John J. Vrablik
*Attorney, Agent, or Firm*—Koda and Androlia

[57] ABSTRACT

A multiple rotary fluid machine which includes a stator and a plurality of coaxial rotors held together, sealing vanes and fluid ports which are all offset alternately in the radial plane and form a multiplicity of rotary fluid machines or stages which are dislocated in the radial plane with respect to each other such that the total flow or torque produced by the multiple fluid machine is uniform at any time in the operating cycle or vary during the working cycle in any predestined manner.

12 Claims, 12 Drawing Sheets

MULTI-CHAMBER ROTARY FLUID MACHINE WITH AT LEAST TWO RING MEMBERS CARRYING VANES

This is a continuation-in-part of application Ser. No. 08/224,666, filed Apr. 7, 1994, now abandoned, which was a divisional application of application Ser. No. 07/974,191 filed Nov. 10, 1992, now U.S. Pat. No. 5,375,985.

BACKGROUND OF INVENTION

1. Field of the Invention

This device relates to multiple rotary fluid machines and more particularly, to multiple rotary fluid pumps and multiple rotary fluid motors.

2. Prior Art

In the prior art there exist rotary fluid pumps and rotary fluid motors.

Some embodiments of such pumps and motors employ a rotor which revolves within a chamber provided in a stator, and the rotor is provided with radially guided vanes which, revolve with the rotor and pass along a path between opposite curved faces of the stator chamber, as the vanes are held in positive engagement with the profile of the stator. Each chamber of the stator is provided with inlet and outlet ports.

Another embodiment of such pumps and motors employ a rotor provided with a groove with opposite curved faces defining plurality of lobes and depressions, and a stator ring inserted into the groove which together with the opposite depressions define a plurality of opposite alternate chambers, a plurality of sealing vanes extending through the ring and engaging with the outer and inner surface of the rotor groove, and fluid passages provided in the ring adjacent to the sealing vanes with alternate fluid passages connected together.

However, such fluid motors or pumps suffer from certain disadvantages. In particular, they are torque and flow restricted with respect to the operating speed.

Another major disadvantage of the prior art rotary machine is the great tendency for generating of pulsations.

The primary reason for the disadvantages of the prior art rotary fluid pumps and motors are the design limitations.

In particular, the vanes switch between a most upper position and a most recessed position during operation. As a result, the driving force radius changes and respectively the output torque for the motor's applications changes too. Furthermore, the volume of the inside chambers defer from the volume of the outside chambers. As a result, the generated flow for pump's application pulsates.

The greatest effect of the generated pulsations is a premature failure of the rotary machine and system, as well as a noise.

Another reason for speed, flow and torque restrictions of the prior art rotary machine is the restricted abruptness of the slope curve between two nearby opposite recessions. More particularly for a certain number of lobes, vanes and physical size of the rotary machine, the displacement depends on the volume defined by the recessions and the ring. An abrupt slope defines a larger volume. However, the abrupt slope restricts the operating speed and cause excessive wear of the vanes. Also it may cause breakage of the vanes because of the large front opposite force.

Consequently, the only alternative to obtain greater displacement capacities is to make the whole machine physically larger.

Generally, physically larger units have higher costs of manufacture, freight, installation, maintenance and handling.

Representative examples of such prior art rotary fluid machines are shown in the following U.S. Pat Nos.:

| | | |
|---|---|---|
| 315,318 | 677,752 | 888,779 |
| 1,249,881 | 723,656 | 1,518,812 |
| 1,811,729 | 1,078,301 | 2,099,193 |
| 2,280,272 | 3,540,816 | 2,382,259 |
| 2,458,620 | 1,872,361 | 4,551,080 |

Still further, the devices of the prior art have another disadvantage in their sliding seals. In particular, the sliding seals are not side pressure and wear compensated. Consequently, after the vanes and adjustment surfaces wear, the high pressure inner chambers and the low pressure outer chambers become at least partially interconnected and the efficiency of the rotary fluid machine will decrease until the machine finally ceases to operate.

SUMMARY OF THE INVENTION

Accordingly, it is a general object of the present invention to provide a rotary fluid machine which is more efficient than that provided by the prior art.

It is another object of the present invention to provide a rotary fluid machine which is not flow and torque restricted with respect to the speed of operation.

It is still another object of the present invention to provide a rotary fluid machine with extremely smooth, pulsationless operation.

It is another object of the present invention to provide a rotary fluid machine capable of producing flow and torque which vary during the working cycle in any predesigned manner.

It is an additional object of the present invention to provide a rotary fluid machine which is simple to manufacture and assemble.

It is yet another object of the present invention to provide seals with a long surface life and constant sealing effectiveness at various operating pressures and therefore a rotary fluid machine with high volumetric efficiency and high torque capabilities whose efficiency and torque does not deteriorate with wear over time.

In keeping with the principles of the present invention, the objects are accomplished by an unique multiple rotary fluid machine, which includes a stator and plurality of coaxial rotors held together, sealing vanes and fluid ports, which are offset alternately in the radial plane and form a multiplicity of rotary fluid machines or stages which are dislocated in the radial plane with respect to each other such that the total flow or torque produced by the multiple fluid machine is uniform at any time in the operating cycle, or the total torque and flow vary in any predesired manner and/or frequency during the operating cycle.

BRIEF DESCRIPTION OF THE DRAWINGS

The above described features and objects of the present invention will become more apparent with reference to the following description taken in conjunction with the accompanying drawing wherein like reference numerals denote like elements and in which.

DETAILED DESCRIPTION OF THE INVENTION

Any of the prior art rotary fluid machines and the relationships and teachings described therein could be used to construct the basic multiple rotary fluid machine except for the invention as described herein below. Such prior art rotary fluid machines are those shown and described in U.S. Pat. No. 2,099,193 and U.S. patent application Ser. No. 271,357 filed on Nov. 10, 1988, U.S. Pat. No. 5,073,097 and U.S. patent application Ser. No. 728,013 filed Jul. 8, 1991, U.S. Pat. No. 5,135,372.

Figure 1A:
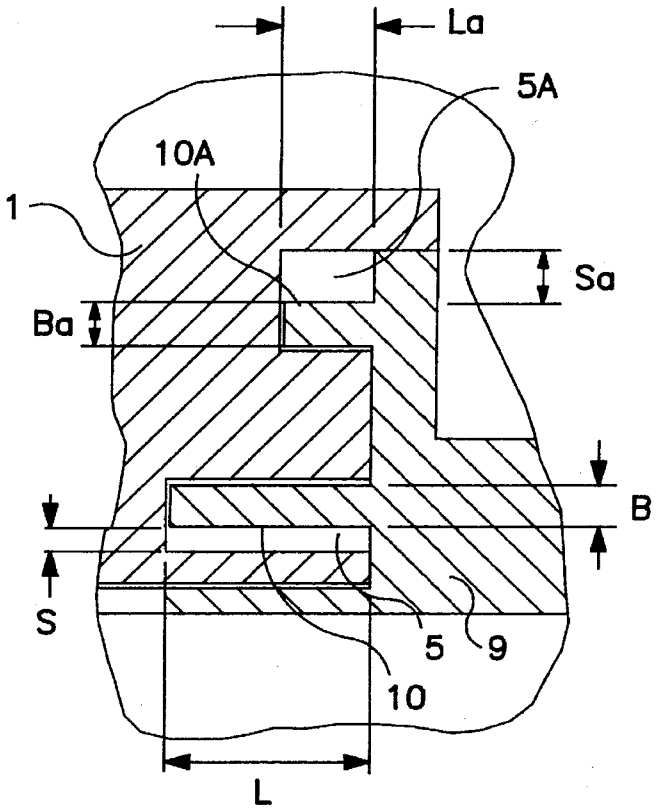
FIG. 1A is a partial cross sectional view of the FIG. 1 along the line 1A—1A.
Figure 1:
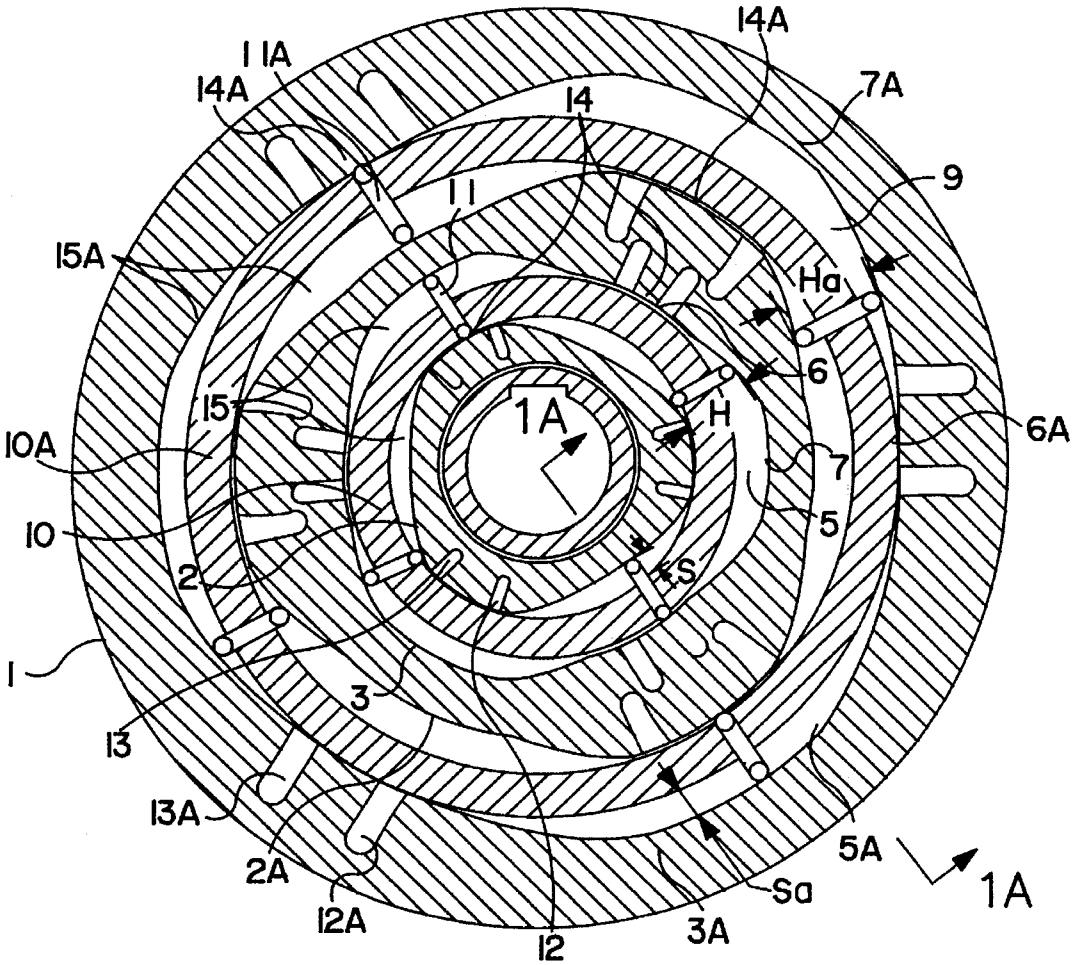
FIG. 1 is a cross-sectional view of a two stage multi-rotary fluid machine, which produce uniform torque and flow, comprised of a mesh of a three-lobe type stator and a four-vane type rotor in accordance with the teaching of the present invention.

Referring particularly to FIG. 1 and the partial section FIG. 1A thereof, shown therein is an uniform torque and flow type multiple rotary fluid machine in accordance with the teachings of the present invention and more particularly a two stage multiple rotary fluid machine with the lobes and fluid ports located on the stator 1 and the sealing vanes located in the rotor 9 and rotate with the rotor; furthermore, the number of the lobes and vanes of the inside stage are equal to the number of lobes and vanes of the outer stage.

The multiple rotary fluid machine of the present invention generally comprises a stator 1, which preferably has a plurality of opposite curved faces 2 and 3, 2A and 3A, defining grooves 5 and 5A, from any type well known in the previous art, as the grooves 5 and 5A are offset and dislocated in the radial plane alternately such that any recession 6 of groove 5 corresponds radially to elevation 7A of groove 5A and any elevation 7 of groove 5 corresponds radially to recession 6A, furthermore preferable grooves are an even number. A multiple rotor 9 is defined by a plurality of rings 10 and 10A which are internally formed and are inserted onto the stator grooves 5 and 5A. Said rings 10 and 10A are provided with radial guide slots for guiding sealing vanes 11 and 11A. All vanes fully extend and retract with one and the same stroke, i.e. the stroke S of vanes 11 is equal to stroke SA of vanes 11A, and vanes are held in positive engagement with the profile of the stator grooves 5 and 5A and shift radially in and out as the rotor 9 rotates such that the total torque or flow produced by the multiple rotary machine is uniform, i.e. one and the same at any time in the whole working cycle. Still further and as can be seen in the partial section of FIG. 1A, the groove 5 is deeper than the groove 5A, the ring 10 is deeper than the ring 10A and each of the rings 10 and 10A are of the same thickness. In particular, these parts are defined by the relationships as follows:

$$S<Sa;\ H<Ha;\ L>La;\ \text{and}\ B=Ba.$$

These same relationships are clear from the FIG. 1.

In addition, if substantially thin plates (FIG. 14) or a seal with substantially sharp extremities (FIG. 15) are utilized: the radial distance between the outer and inner surfaces of the stator is equal and coincide with the seal length and the length of the line defined by two opposite sealing points between the vane extremities and the stator surfaces at any time and the sharp extremities angles <a & <a' shall be equal or smaller than the slope angles <b & <b'.

Also, if any other type seal is utilized, the radial distance between the outer and inner surfaces of the stator is equal and coincide with the seal length and the length of the line defined by two opposite sealing points between the vane extremities and the stator surfaces only at the circular zones of the guiding surfaces of the stator. In any other position, the length of the vane coincide but is not equal with the radial distance between the outer and inner surfaces of the stator, and the length of the line defined by two opposite sealing points between the vane extremities and the stator surfaces is equal or not equal with the length of the vane and do not coincide with the length of the vane and the radial distance between the outer and inner surfaces of the stator.

The total torque produced by the rotary fluid machine is defined by the sum of the torques produced by each sealing vane 11 and 11A, which is defined by the useful area of each vane, i.e. the area of the vane between the particular rotary ring 10 or 10A and applied guide surfaces of radius of that area and with the fluid pressure. The pressure force radius is the radially distance to the center of the force acting on a vane. Inlet ports 12 and 12A and outlet ports 13 and 13A (or the reverse) are provided on the stator lobes 14 and 14A and communicate simultaneously with the applied chambers 15 and 15A. Ports 12 and 13 are connected to ports 12A and 13A through internal passages (not shown) in any manner well known in the art.

In operation, stator 1 is held stationary and pressurized fluid is injected into all inlet ports 12 and 12A and taken out of all outlet ports 13 and 13A (or the reverse) simultaneously. As a result the rotor 9 would start to rotate together with the sealing vanes 11 and 11A. As vanes 11 and 11A are in positive engagement with the profile of the stator grooves 5 and 5A, the vanes 11 inserted into groove 5 will reciprocate in an opposite manner with respect to vanes 11A inserted into groove 5A i.e. a recessed position of any vane 11 radially corresponds to a lifted position of vane 11A and vice versa. Considering that vanes 11 and 11A are located on one and the same line radially and a multiple of their area with respectively pressure force radius is equal, the produced torque or flow would be uniform at any time during the working cycle.

Figure 2:
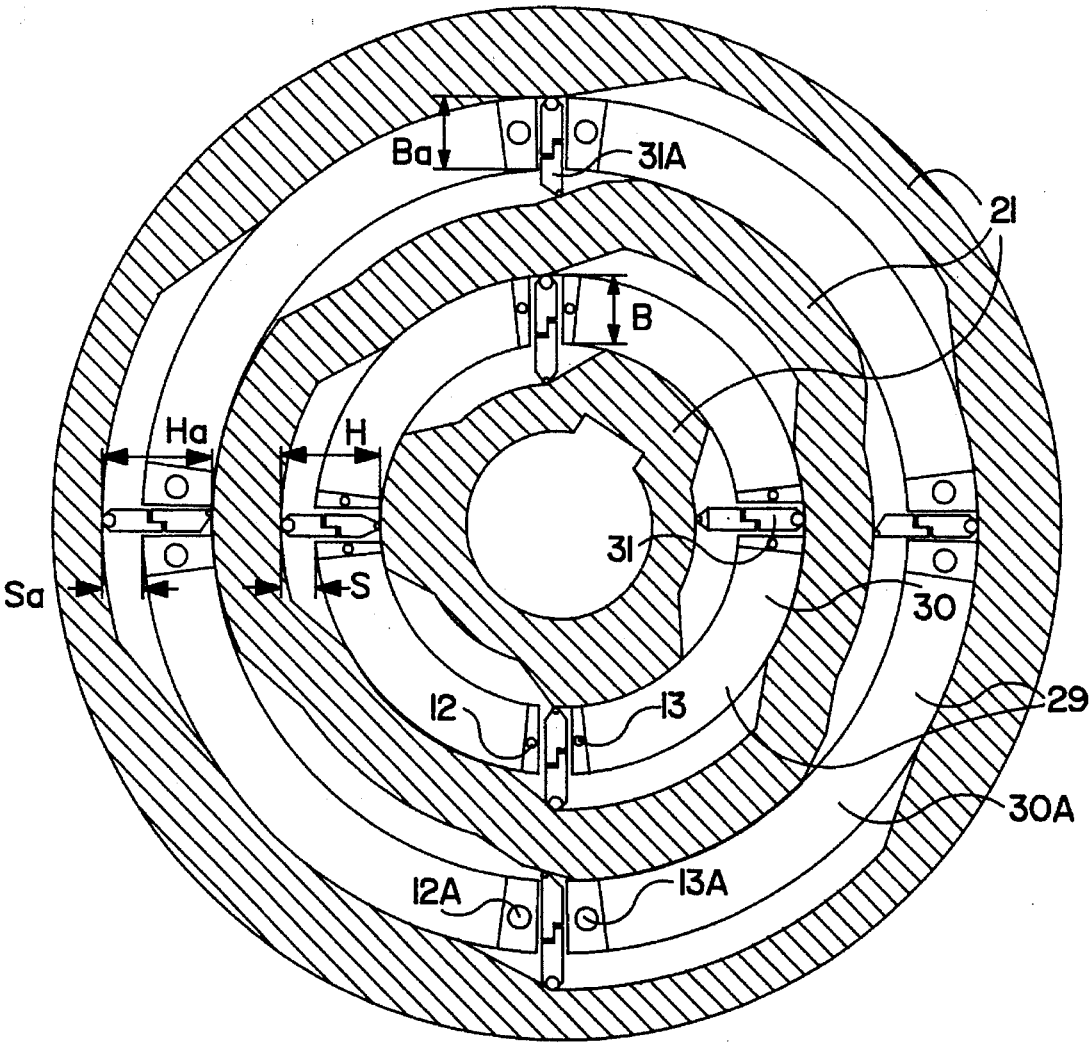
FIG. 2 is a cross-sectional view of a two stage multi-rotary fluid machine, comprised of a mesh of a three lobe type rotor and a four-vane type stator in accordance with the teaching of the present invention.

Referring to FIG. 2 shown is a second two stage embodiment of the present invention, wherein lobes are on the rotor 21 and vanes and ports are on the stator 29 and the number of lobes and vanes 31 of the first stage is equal to the number of lobes and vanes 31A of the second stage. Also the second stage is not dislocated in the radial plane with respect to the first stage, i.e. lobes and recessions from the first stage corresponds radially to lobes and recessions of the second stage. Furthermore, the rotor 21 rotates while the stator 29 is stationary. Also, the stator 29 comprises a plurality of rings 30 and 30A. Similar to FIG. 1 and its associated partial section of FIG. 1A, in FIG. 2, there are certain size relationships as follows:

S=Sa; H=Ha; B=Ba; and L is either=or not=La.

Figure 3:
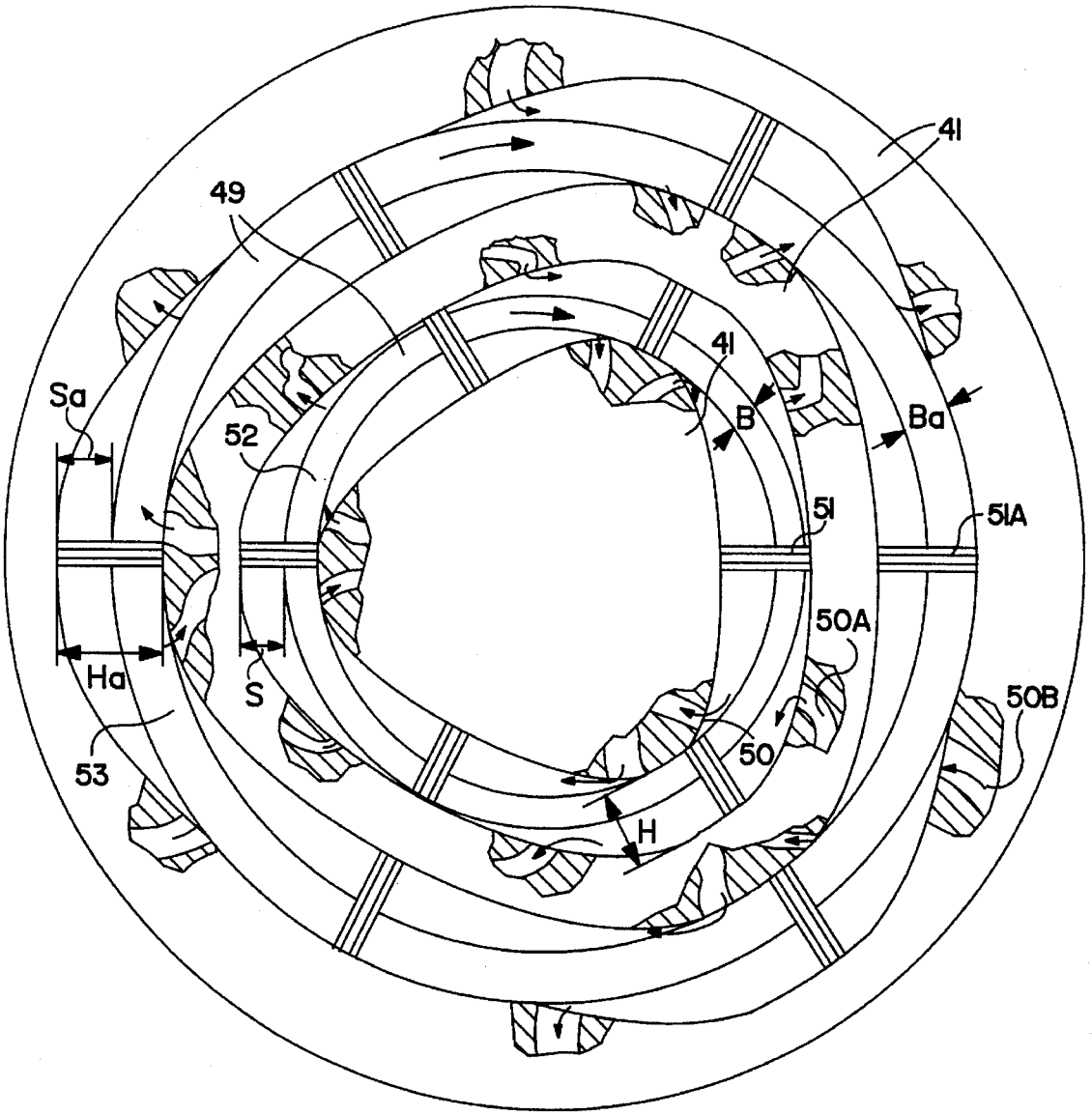
FIG. 3 is a cross-sectional view of a two stage multi-rotary fluid machine, comprised of a mesh of a three lobe stator and a four-vane rotor in accordance with the teaching of the present invention.

Referring to FIG. 3 shown is a third two stage embodiment of the present invention, where lobes and ports 50, 50A and 50B are on the stator 41 and vanes 51 and 51A are on the rotor 49 and rotate with rotor 49. The number of lobes and vanes of the first stage is equal of the number of lobes and vanes of the second stage. The second stage is not dislocated in the radial plane in respect of the first stage, i.e. lobes and recessions from the first stage correspond radially to lobes and recessions of the second stage. Furthermore, the rotor 29 comprises a plurality of rings 52 and 53. Similarly to FIG. 1 and its associated partial section of FIG. 1A and FIG. 2, certain relationships exist for FIG. 3 as follows:

S=Sa; H<Ha; B<Ba; and L is either = or not = La.

Figure 12:
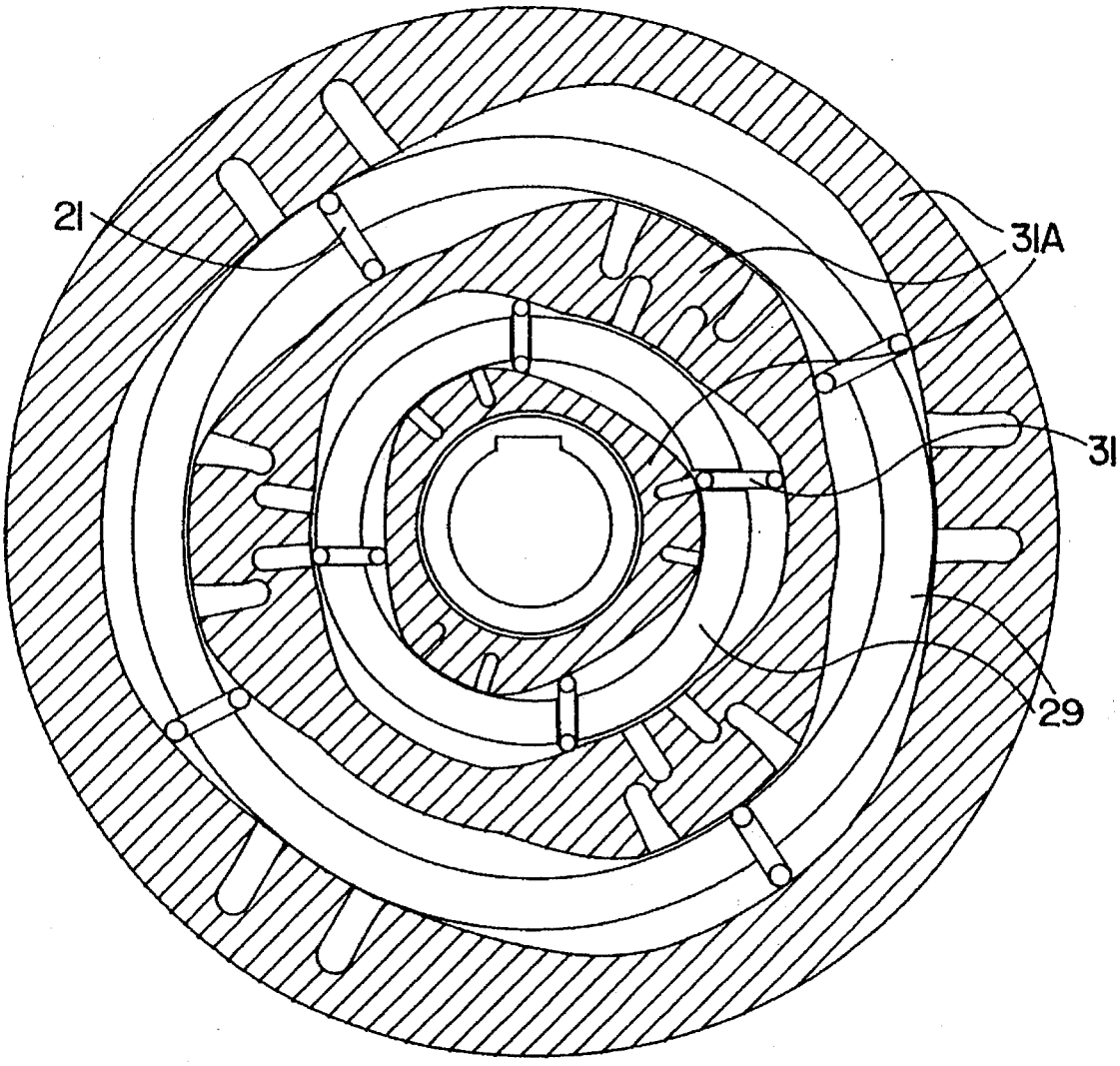
FIG. 12 is a cross-sectional view of a two stage multi-rotary fluid machine comprised of a mesh of a three-lobe type stator and a four vane type rotor, as the first stage stator and rotor are dislocated in radial plan with respect to the second stage stator and rotor to provide varying flow and torque in a predestined manner.

It is obvious for any one skilled in the art, that the number of stages of the multiple rotary fluid machine can be increased to more than two. The multiple rotary fluid machine can produce not only uniform flow and torque but also varying flow and torque during the working cycle in any predestined manner. That could be achieved by varying the number of the multiplicity of vanes and lobes of each stage, by varying the number of stages, by varying the stroke and the length of the vanes, ring radial size, chamber axial size for the different stages, as well as, by dislocating the multiplicity of lobes and vanes with respect of each other for the different stages, as shown in FIG. 12. Also, it should be apparent that the number of stages could be increased or decreased to any number of stages and the number of lobes and vanes of each stage can be made equal or unequal. Still further, the location of the lobes and the radial plane of each stage with respect to other stages can be either aligned radially or not.

It should be apparent to one skilled in the art that all embodiments operate in substantially the same manner as discussed with reference to the first embodiment.

Figure 4:
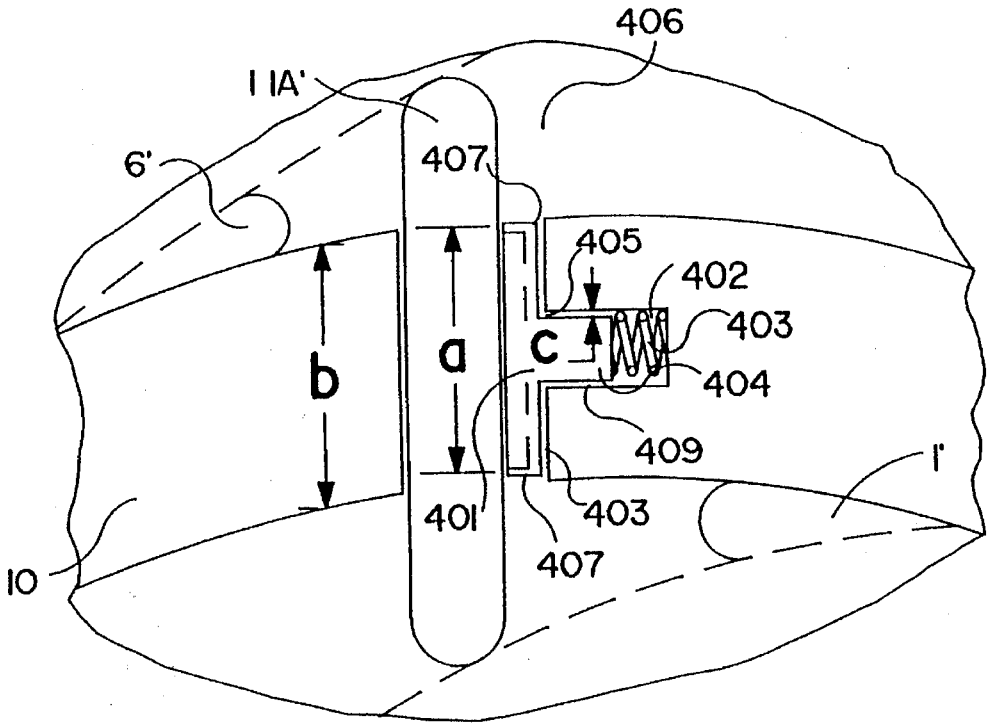
FIG. 4 is a partial cross-section of the ring in FIG. 1 illustrating a vane and a sliding seal with side wear and pressure compensator.
Figure 5:
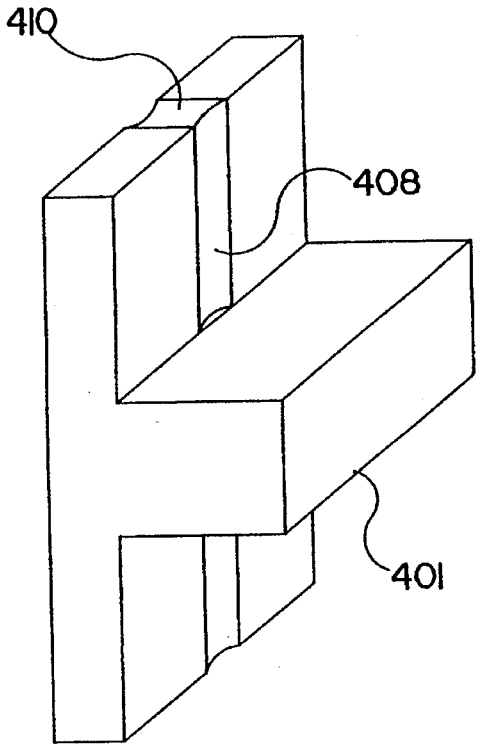
FIG. 5 is a perspective view of the wear and pressure compensator.

Referring to FIGS. 4 and 5, shown therein is a sliding seal side wear and pressure compensator. The compensator comprises a T-shaped portion 401 which is inserted into a slot 402 provided in the rotor ring 10. A spring 403 is provided in the slot 402 between the end of the T-shaped portion 401 and the bottom of the slot 402. The slot 402 is substantially longer in the radial direction than the radial dimension of the portion 404 of the T-shaped part 401 and the portion 404 is inserted into the slot 402. Since the slot 402 is substantially longer in the radial direction than the portion 404, a passage 405 is formed with a radial dimension c which allows free radial shuttling of the T-shaped part 401. The axial dimension of the T-shaped part 401 is substantially the same as the axial dimension of the ring 95. The radial dimension a of the T-shaped part 401 is equal to or smaller than the difference between the radial dimension b of the ring 95 and the passage radial dimension c, i.e. a=(b−c).

In operation, if a high pressure is applied to the outer side 406 and the inner side 407 of the part 401, the pressurized fluid will enter into the slot 402 through the grooves 408 and push the T-shaped part 401 against the vane 11A'. Furthermore, if the inner side 407 of the T-shaped part 401 is exposed to a low pressure, the part 401 will shift radially towards the center of the rotor as a result of the pressure difference. In addition, the inserted portion 404 of the part 401 will seal with the surface 409 of the slot 402 and maintain the pressure difference. Conversely, if a low pressure is provided at the outer side 406 and a high pressure at the inner side 407, the part 401 will shift radially outwardly from the center. In addition, the T-shaped part 401 is further provided with a surface groove 410 to connect the grooves 408 to the pressure on the sides 406 and 407 when passing over the lobes. Still further, the spring 403 is selected to sufficiently bias the T-shaped part 401 against the vane 11A' to provide sufficient sealing force to seal the vane 11A' to the ring 10 during starting conditions.

Figure 6:
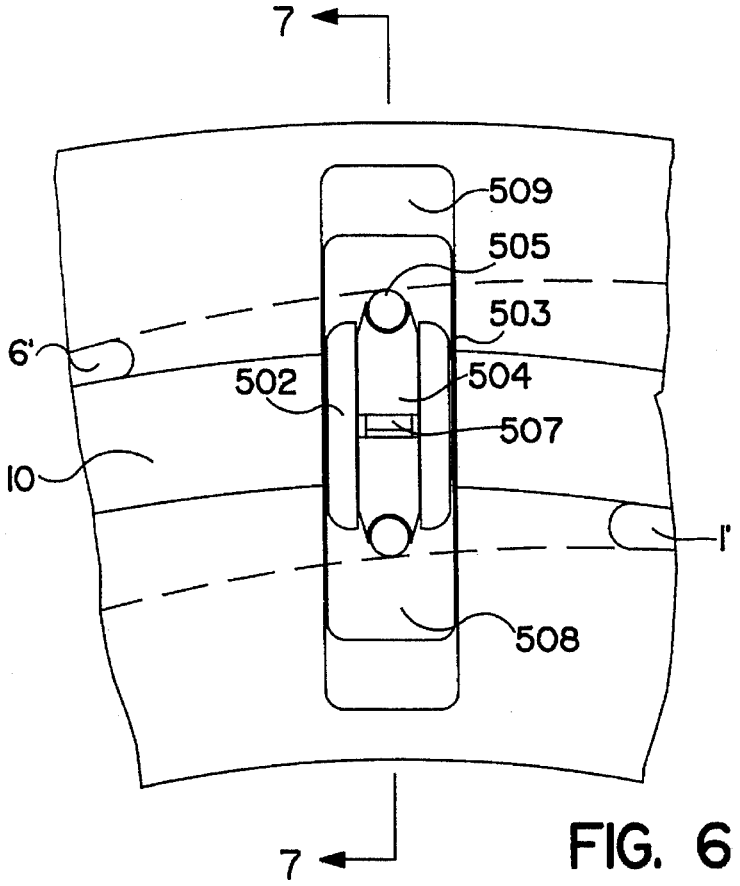
FIG. 6 is a partial front view taken from the rotor illustrating a high thrust transfer sliding seal.
Figure 7:
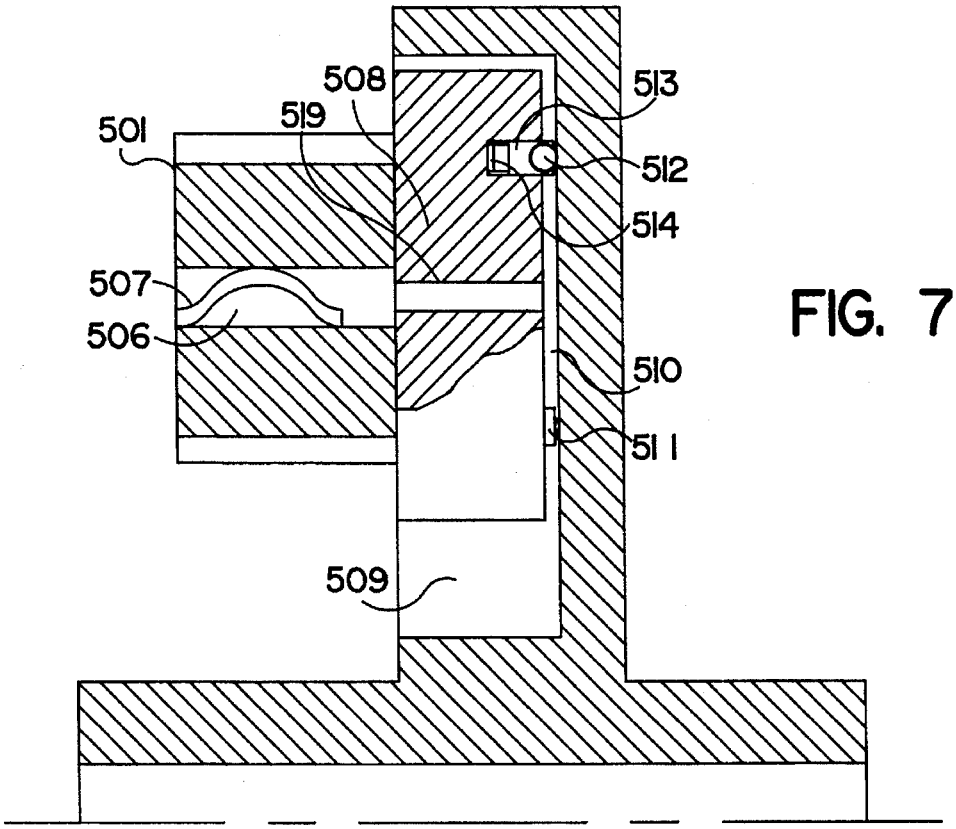
FIG. 7 is a radial sectional view of FIG. 6 along the line 7—7.
Figure 8:
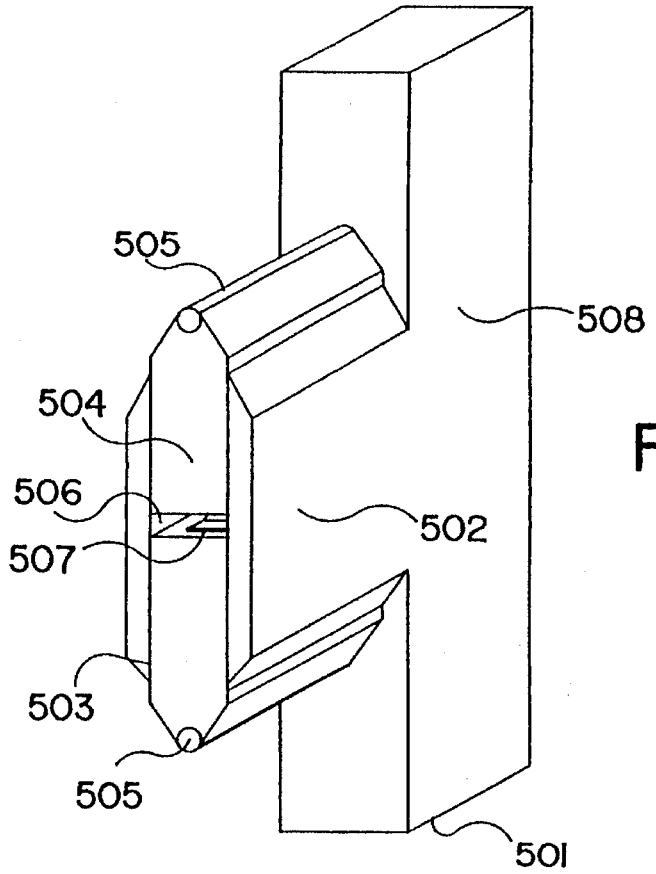
FIG. 8 is a perspective view of the high thrust sliding seal of FIG. 6.

Referring to FIGS. 6, 7 and 8, shown therein is a high thrust transfer sliding seal utilized in the present invention. The high thrust transfer sliding seal employs a sliding body 501 with a T-shaped profile with a short portion 502 provided with a radial slot 503. The radial slot 503 holds the two vanes 504 and a roller 505 is provided at the outer tips of the vanes 504. The inner tips of the vanes 504 form a chamber 506 which is provided with a spring means 507 that pushes the vanes 504 apart. The long portion 508 of the sliding body 501 is accommodated in a radial slot 509 formed in the rotor or the stator of the rotary fluid machine. A small passage 519 is provided from the back side of the long portion 508 and extends to the chamber 506 formed between the vanes 504.

The slot 509 has substantially the same width as the long portion 508 of the body 501 (to insure proper sealing) and is substantially longer in radial dimension (to allow shuttling of the body 501) and larger in the axial dimension (depth) than the long portion 508 of the body 501 (to form a pressure chamber 510). The long portion 508 of the body 501 is provided with a spring means 511 generally comprised of a roller ball 512 supported by guide 513 and biased by a spring 514.

In operation, operating pressure is applied through the chamber 510, the passage 519 to the pressure chamber 506 and pushes proportionally vanes 504 apart for radially sealing with the stator profile or separating the high pressure zones from the low pressure zones. The operating pressure is also applied to the chamber 510 to provide an axial force proportional to the operating pressure. The spring means 511 and 507 are selected such that they provide a proper axial force for sealing during the start-up conditions.

Figure 9:
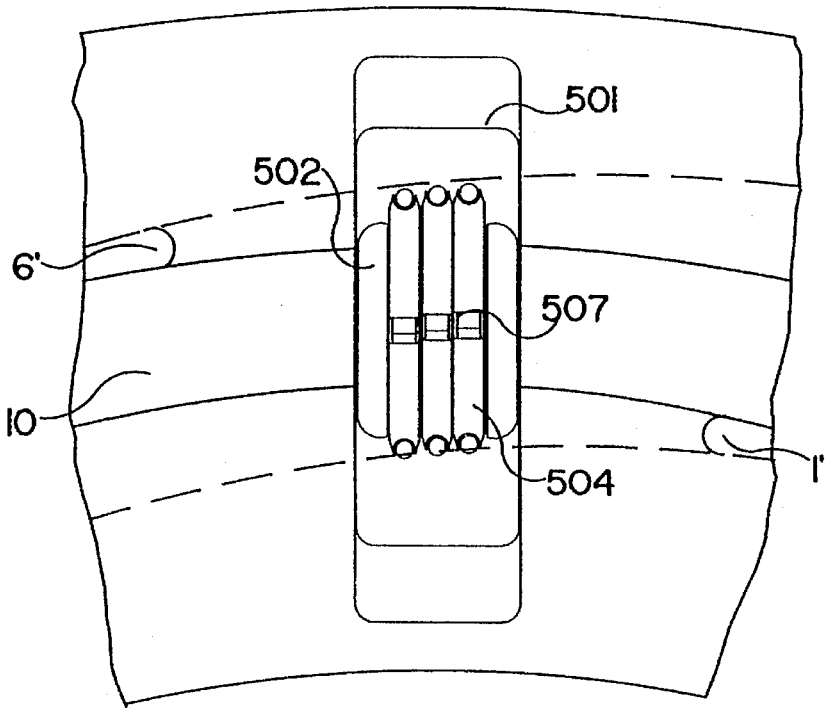
FIG. 9 is a partial front view of a portion of the rotor illustrating a multiplate high thrust transfer sliding seal.

Referring to FIG. 9, shown therein is a high thrust transfer sliding seal similar to that of FIGS. 6 through 7; however, in this construction the vanes 504 are made relatively thin and a plurality of vanes 504 is provided between the short portions 502 of the sliding body 501. In this way, a better seal may be provided which more accurately follows the contours of the lobes.

Figure 10:
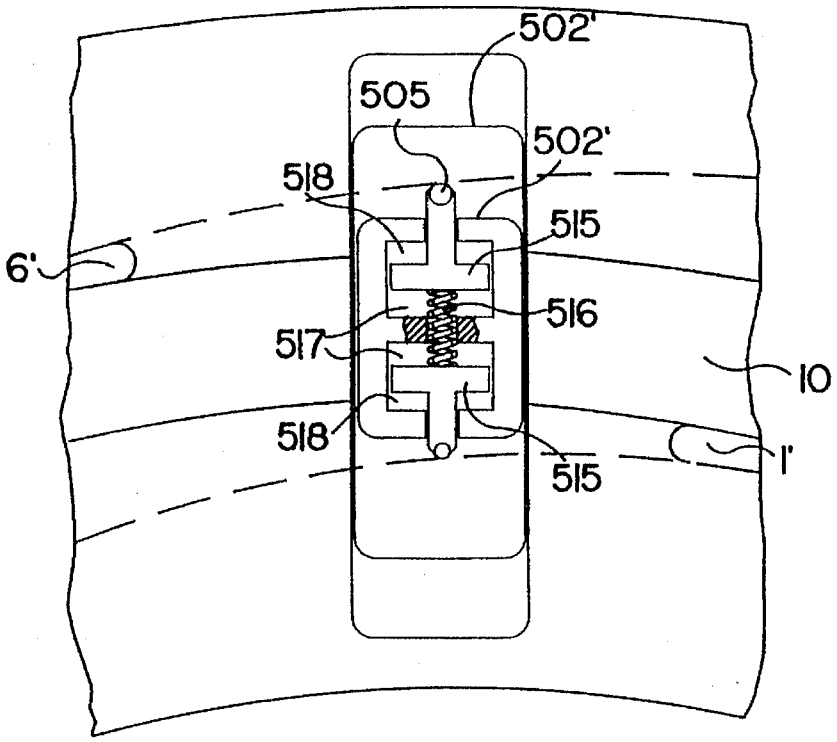
FIG. 10 is a partial front view of the rotor illustrating a heavy duty high thrust transfer sliding seal.

Referring to FIG. 10, shown therein is a heavy duty high thrust transfer sliding seal. This seal employs piston type vanes 515 with a spring 516 provided therebetween and chambers 517 and 518 are formed on each side of the piston portion of the piston type vanes 515.

In operation, the operating pressure is applied to the chambers 517 via a passage 519 in a similar manner as in FIG. 7 and the low pressure is applied to the chambers 518 and the piston type vanes 515 are pushed outwardly by the operating pressure in the chamber 517 to form a seal.

Figure 11:
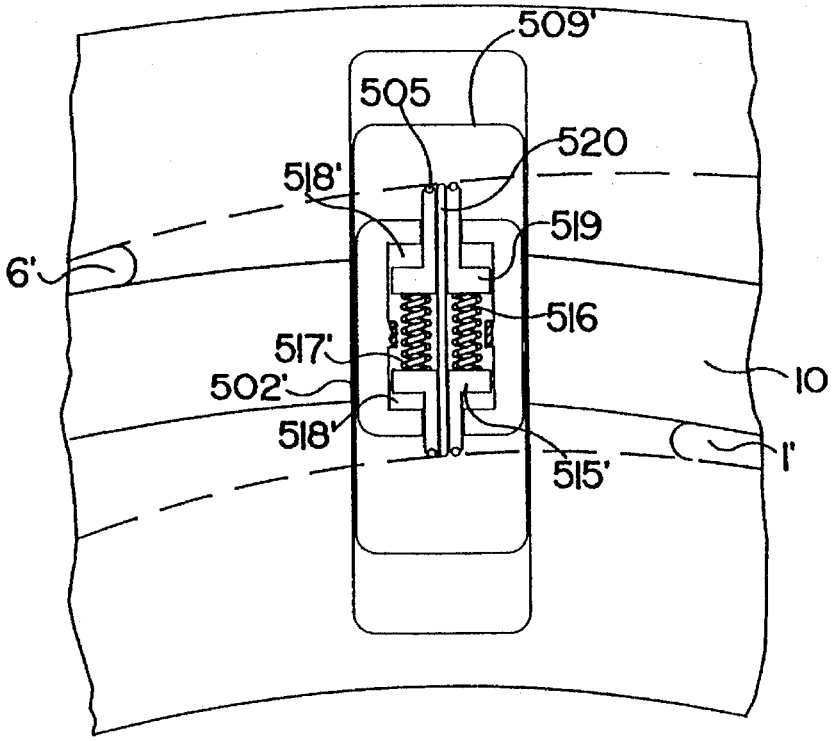
FIG. 11 is a partial front view of the rotor illustrating another embodiment of a heavy duty high thrust transfer sliding seal.

Referring to FIG. 11, shown therein is a heavy duty high thrust transfer sliding seal similar to that of FIG. 10 except that pairs of piston type vanes 515' are provided. Since the piston type vanes 515' are provided in pairs, the remainder of the elements are further provided in pairs and the chambers 517 and 518 are radially divided by wall 520.

In operation, this dual piston type vane operates substantially the same as that of FIG. 10.

In the present invention, it is important that the correlation between the length of the vanes, the radial dimension between the stator guiding surfaces and the line defined by two opposite sealing points be understood and defined. Accordingly, following is an analysis of the correlation between the length of vanes, radial dimension between the stator guiding surfaces and the line defined by two opposite sealing points.

Figure 13:
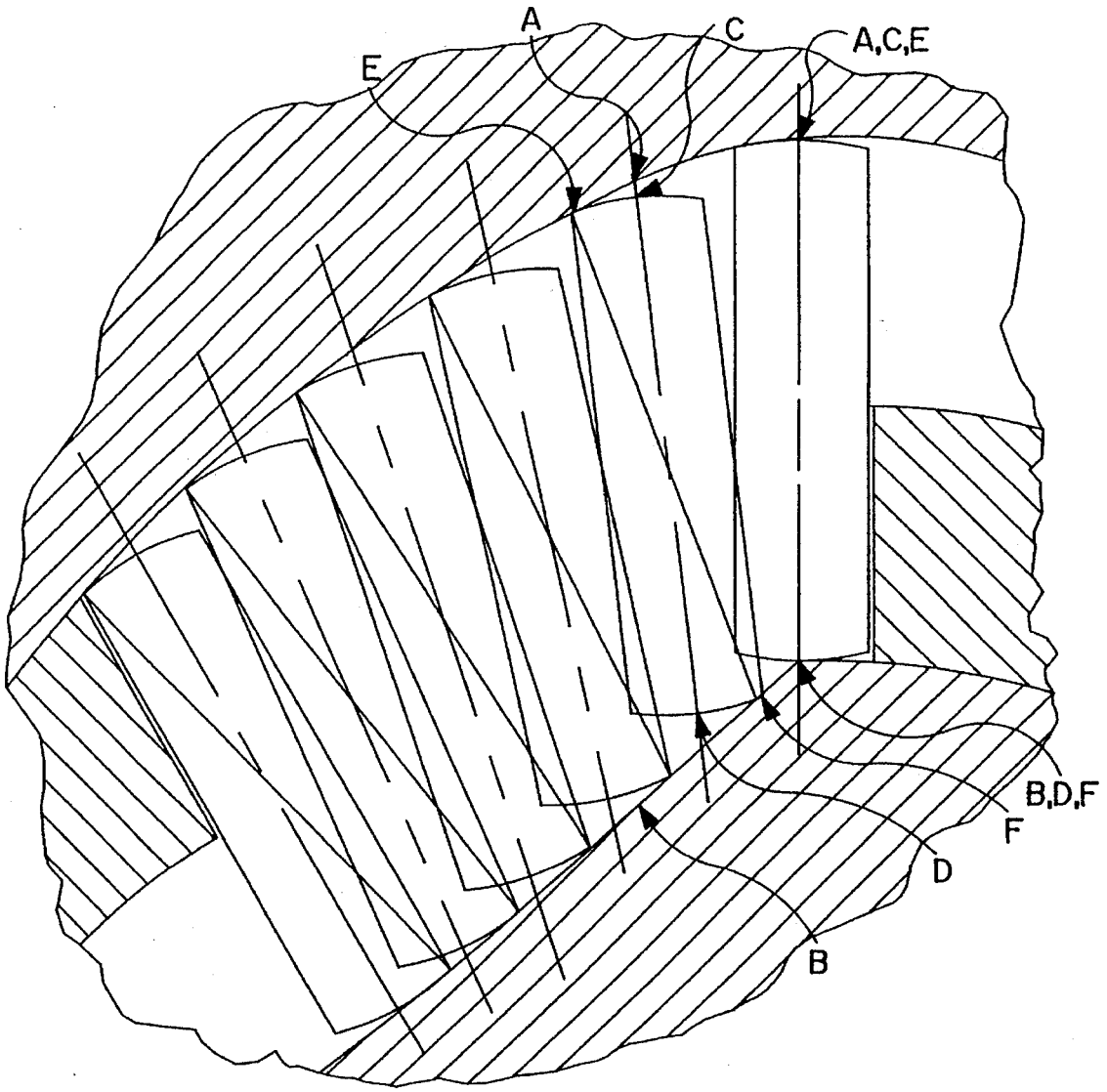
FIG. 13 slope zone and vanes with roundness of the seal tips with radius that is larger than the half of the vane width.
Figure 16:
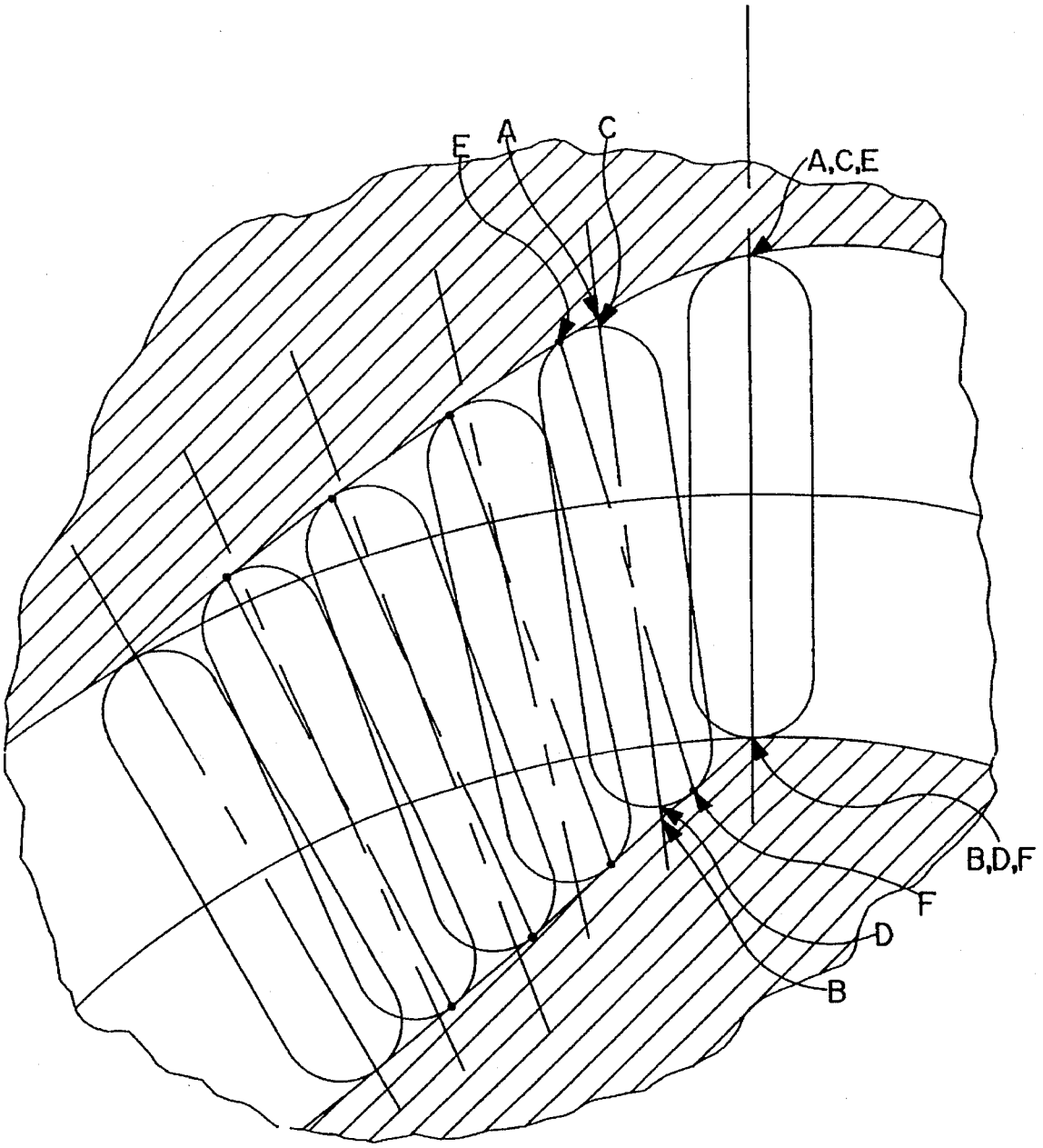
FIG. 16 slope zone and vanes with roundness of the seal tips with radius that is equal to the half of the vane width.

Referring to FIG. 13 and FIG. 16, shown are the slope zones of two embodiments of the present invention, that utilized seals with two different roundness of the seal extremities. It is apparent that the radial distance AB between the guiding surfaces of the stator is equal and coincide with the radial length of the vane CD and the length of the line defined by two opposite sealing points EF only in the circular zones of the stator guiding surfaces, i.e., the zones of the most upper top of the cams and the most down recede position. In any other position, the length of the vane coincide but is not equal with the radial distance between the outer and inner surfaces of the stator, and the length of the line defined by two opposite sealing points between the vane extremities and the stator surfaces is equal or not equal with the length of the vane and do not coincide with the radial length of the vane and the radial distance between the outer and inner surfaces of the stator.

Figure 14:
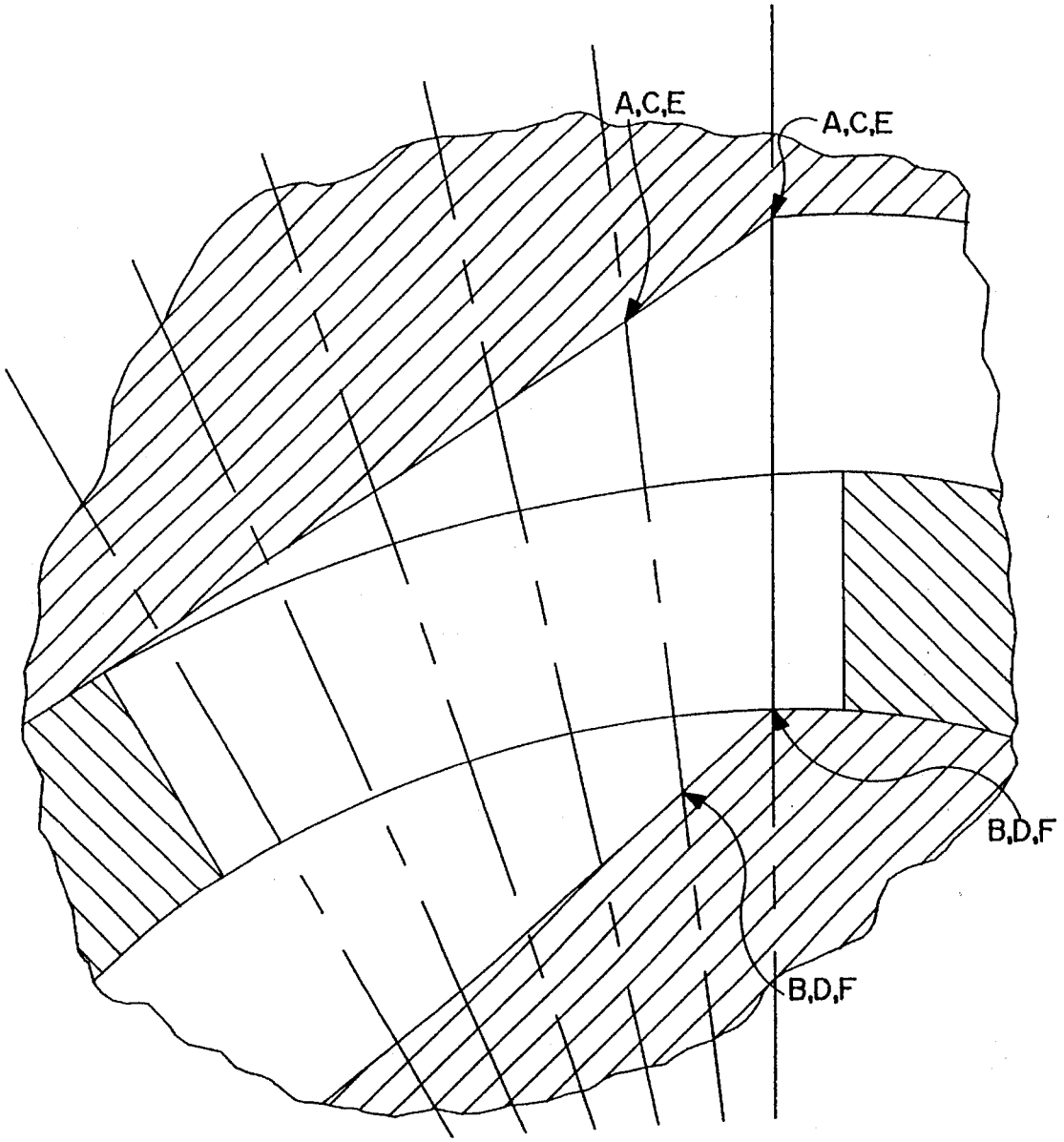
FIG. 14 slope zone and substantially thin vanes.
Figure 15:
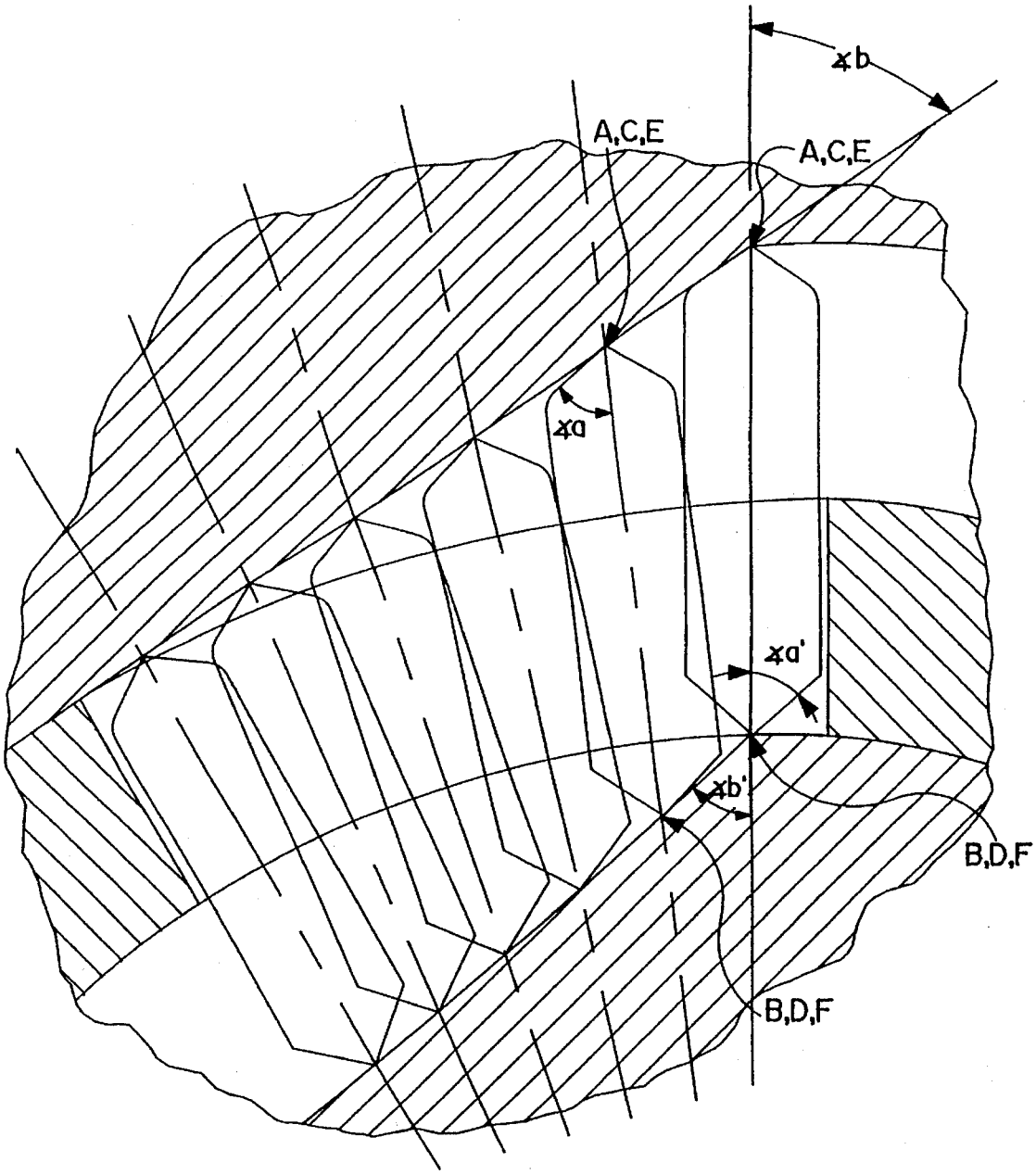
FIG. 15 slope zone and vanes with substantially sharp tips.

Referring to FIG. 14 and 15, shown are the slope zones of two embodiments of the present invention, that utilize a rotor seal with substantially sharp extremities (FIG. 15) and a plurality of substantially thin seals (FIG. 14) (only one is shown for clarity). It is apparent that only in this case the radial distance between the outer and inner surfaces of the stator AB is equal and coincide with the radial length of the seal CD and the length of the line defined by two opposite sealing points between the vane extremities and the stator surfaces EF.

Accordingly, if substantially thin plates or a seal with substantially sharp extremities are utilized: the radial distance between the outer and inner surfaces of the stator is equal and coincide with the seal length and the length of the line defined by two opposite sealing points between the vane extremities and the stator surfaces at any time and the sharp extremities angles <a & <a' shall be equal or smaller than the slope angles <b & <b'.

Alternately, if any other type of seal is utilized: the radial distance between the outer and inner surfaces of the stator is equal and coincide with the seal length and the length of the line defined by two opposite sealing points between the vane extremities and the stator surfaces only at the circular zones of the guiding surfaces of the stator. In any other position, the length of the vane coincide but is not equal with the radial distance between the outer and inner surfaces of the stator, and the length of the line defined by two opposite sealing points between the vane extremities and the stator surfaces is equal or not equal with the length of the vane and do not coincide with the length of the vane and the radial distance between the outer and inner surfaces of the stator.

It should further be apparent to those skilled in the art that the above described embodiments are merely illustrative of but a few of the many possible specific embodiments which represent the applications and principles of the present invention. Numerous and varied other arrangements can be readily devised by those skilled in the art without departing from the spirit and scope of the present invention.

I claim:

1. A multi-chamber rotary fluid machine comprising:

an inner member provided with a plurality of lobes;

at least one intermediate member provided with inner and outer surfaces which correspond to the plurality of lobes of said inner member;

a housing surrounding said intermediate member, said housing being provided with a plurality of depressions which correspond to said plurality of lobes;

at least two ring members, said ring members being provided between said inner member and said intermediate member and between said intermediate member and said housing and together with said inner member, intermediate member and housing defining a plurality of fluid chambers, said at least two ring members being rotatable relative to said intermediate members and said housing;

a plurality of sealing vanes extending through each of said ring members and the plurality of sealing vanes extending through one ring member engaging with an outer surface of the inner member and an inner surface of the intermediate member and the sealing vanes extending through the other of said at least two ring member engaging with an outer surface of said intermediate member and an inner surface of said housing, said sealing vanes being provided in any number relative to the number of lobes of said inner member; and a plurality of fluid communicating means provided in said inner member, intermediate member and housing with every other one of said plurality of fluid communicating means being coupled together and with each of said plurality of said fluid communicating means in communication with said plurality of fluid chambers.

2. A rotary fluid machine according to claim 1, wherein means is provided for applying fluid to all of said plurality of chambers at the same time and for taking fluid out of all of said plurality of chambers at the same time.

3. A rotary fluid machine according to claim 1, wherein said sealing vanes comprise wear compensating vanes for compensating for wear of said inner and outer members, said housing and ends of said sealing vanes.

4. A multi-chamber rotary fluid machine according to claim 3, wherein said wear compensating vanes comprise a plurality of thin plates wherein a radial distance between an outer surface of said inner member and an inner surface of said intermediate member is equal and coincides with a length of said sealing vanes and a length of a line defined by two opposite sealing points on each thin plate.

5. A multi-chamber rotary fluid machine according to claim 3, wherein said wear compensating means comprise a seal with sharp extremities wherein a radial distance between an outer surface of said inner member and an inner surface of said intermediate member is equal and coincides with a length of a sealing vane and a length of a line defined by two opposite sealing points on each thin plate and an angle of said sharp extremities shall be equal to or less than a slope of the outer surface of the inner member.

6. A multi-chamber rotary fluid machine according to claim 3, wherein a radial distance between the surface of said inner member and an inner surface of said intermediate member is equal and coincide with a length of said seal and a length of a line defined by two opposite sealing points between extremities of the sealing vane only at circular zones of the surfaces of the inner member and the inner surface of the intermediate member.

7. A multi-chamber rotary fluid machine according to claim 3, wherein said wear compensating means comprise a radially extending slot through which each of said plurality of sealing vanes extends, a circumferential slot provided in each of said radially extending slots, a T-shaped member with the cross portion of said T-shaped member engaging with a side surface of said sealing vane extending through said radially extending slot and a stem extending into said circumferential slot and a spring means provided between an end of said stem and a bottom of said circumferentially extending slot for biasing said cross portion into engagement with said sealing vane.

8. A multi-chamber rotary fluid machine according to claim 7, wherein a width of said stem of said T-shaped member is smaller than a radial dimension of said circumferentially extending slot and said cross portion of said T-shaped member is provided with radially extending grooves for communicating pressure from said plurality of fluid chambers into said circumferentially extending slot.

9. A multi-chamber rotary fluid machine according to claim 3, wherein said wear compensating vanes comprise two oppositely extending sealing members extending in a radial direction with an interstice therebetween and a spring member provided in said interstice.

10. A multi-chamber rotary fluid machine according to claim 9, wherein each of said oppositely extending sealing vanes is provided with a roller at an end thereof.

11. A multi-chamber rotary fluid machine according to claim 1, wherein said ring member provided between said inner and intermediate members is axially deeper than said ring member provided between said intermediate member and said housing.

12. A multi-chamber rotary fluid machine according to claim 11, wherein a radial distance between the surface of said inner member and an inner surface of said intermediate member is equal and coincides with a length of said seal and a length Of a line defined by two opposite sealing points between extremities of the sealing vane only at circular zones of the surfaces of the inner member and the inner member of the intermediate member.

* * * * *